US007695029B2

(12) United States Patent
Ramsauer

(10) Patent No.: US 7,695,029 B2
(45) Date of Patent: Apr. 13, 2010

(54) TOLERANCE COMPENSATING DEVICE FOR ROTATING AND TILTING BOLTS

(76) Inventor: Dieter Ramsauer, Max-Klein Street, D-58332 Schwelm (DE)

( * ) Notice: Subject to any disclaimer, the term of this patent is extended or adjusted under 35 U.S.C. 154(b) by 0 days.

(21) Appl. No.: 10/592,612

(22) PCT Filed: Mar. 3, 2005

(86) PCT No.: PCT/EP2005/002223

§ 371 (c)(1),
(2), (4) Date: Apr. 26, 2007

(87) PCT Pub. No.: WO2005/090722

PCT Pub. Date: Sep. 29, 2005

(65) Prior Publication Data

US 2008/0036221 A1 Feb. 14, 2008

(30) Foreign Application Priority Data

Mar. 10, 2004 (DE) ..... 20 2004 003 707 U

(51) Int. Cl.
*E05C 5/00* (2006.01)

(52) U.S. Cl. ..... 292/67; 292/63; 292/DIG. 56; 292/DIG. 8

(58) Field of Classification Search ..... 292/63–69, 292/DIG. 56, DIG. 8, DIG. 19
See application file for complete search history.

(56) References Cited

U.S. PATENT DOCUMENTS 5,165,738 A * 11/1992 McCormack ..... 292/67
6,041,627 A * 3/2000 Buckland ..... 70/78
6,568,226 B1 * 5/2003 Ramsauer ..... 70/127
6,606,889 B1 8/2003 Tweedy
6,854,774 B2 * 2/2005 Magnusson ..... 292/165
6,953,209 B2 * 10/2005 Jackson et al. ..... 292/66
2004/0012208 A1 1/2004 Ruiz et al.

FOREIGN PATENT DOCUMENTS

WO 00/31365 7/2000
WO 00/73605 12/2000

* cited by examiner

*Primary Examiner*—Peter M. Cuomo
*Assistant Examiner*—Mark Williams
(74) *Attorney, Agent, or Firm*—Eugene Ledonne; Joseph W. Treloar; Frommer Lawrence & Haug LLP

(57) ABSTRACT

The description relates to a tolerance compensating device for rotating bolts and swiveling bolts, in particular a tolerance compensating device for non-engaging tongues, that is, for example, for pull-turn bolts or swiveling bolts of closures for mounting in thin walls such as sheet-metal cabinets with a frame and door. The closure has a housing which holds a pull-turn bolt so as to be axially displaceable and rotatable or a housing which supports a swiveling bolt, which bolt is provided near its free end with a bore hole in which a back-engaging device is held to as to be displaceable perpendicular to the back-engagement plane. According to the invention, the back-engaging device has a spring which forces the back-engaging device in direction of the back-engagement surface in the closed position of the closure.

15 Claims, 3 Drawing Sheets

TOLERANCE COMPENSATING DEVICE FOR ROTATING AND TILTING BOLTS

CROSS-REFERENCE TO RELATED APPLICATIONS

This application claims priority of International Application No. PCT/EP2005/002223, filed Mar. 3, 2005 and German Application No. 20 2004 003 707.6, filed Mar. 10, 2004, the complete disclosures of which are hereby incorporated by reference.

BACKGROUND OF THE INVENTION a) Field of the Invention

The invention is directed to a tolerance compensating device for rotating and swiveling bolts. In particular, the invention relates to a tolerance compensating device for non-engaging tongues, that is, for pull-turn bolts or swiveling bolts of closures for mounting in thin walls, such as sheet-metal cabinets with a frame and door, wherein the closure has a housing which holds a pull-turn bolt so as to be axially displaceable and rotatable or a housing which supports a swiveling bolt, which bolt has a bore hole near its free end in which a back-engaging device is held to as to be displaceable perpendicular to the back-engagement plane.

b) Description of the Related Art

WO 00/31365 discloses a rotating bolt closure with a pull device in which the bolt is provided at its free end with an internal thread in which a back-engaging device formed as a screw is held so as to be adjustable perpendicular to the back-engagement plane. Adjustment is provided by means of a lock nut. This adjustment is complicated because a lock nut must be loosened, then the back-engaging device must be moved to the appropriate distance by turning, and then the lock nut must be tightened again.

WO 007/73605 shows a swivel lever closure in the drawing accompanying the Abstract. The swivel lever itself forms the back-engaging device. There is no possibility provided for adjustment.

OBJECT AND SUMMARY OF THE INVENTION

It is the primary object of the invention to provide a tolerance compensating device of the type mentioned above which can either be adjusted very simply and quickly or which does not require any adjustment at all.

The above-stated object is met according to an embodiment form in that the back-engaging device has a spring which forces the back-engaging device onto the back-engagement surface in the closed position of the closure. Therefore, no adjustment is required, but it is also not fixed.

According to an embodiment form, the back-engaging device can be a head pin which is displaceable in the bolt against spring force. No adjustment is required in this case either; rather, the spring device provides for adapting to the distance between the door leaf on one side and the back-engagement surface of the door frame on the other side.

In order to limit the movement of the pin due to the spring force, it can be advantageous to provide a retaining ring device in the base of the pin.

According to another embodiment form, the driveshaft is provided with a noncircular cross section for pre-adjustment of the tolerance compensation and has, e.g., an axially extending groove or flattened portion, and the rotating bolt has an opening which fits this cross section. Holding devices are provided which force the rotating bolt outward, and a stop device, for example, in the form of a nut which is screwed onto the driveshaft, holds the rotating bolt axially. Insofar as the driveshaft has a noncircular cross section and the portion of the claw coupling that is rigid against rotation with respect to the driveshaft has an opening which fits this cross section, it would be advantageous according to a further development of the invention to provide holding devices which press the coupling parts or coupling sides together. In particular, these holding devices can be formed by a spiral spring which is slid onto the shaft. The coupling part which contacts the spring can advisably have a projecting rim or grip collar to simplify handling.

However, the holding devices can also be a nut such as a knurled nut which is screwed onto the shaft.

The actuation shaft which is noncircular in cross section advisably has at least one axially extending flattened portion and this flattened portion advisably carries an adjusting graduation to facilitate handling and, in particular, to implement preadjustable distances.

In the present embodiment form, the coupling disk has four claws or projections/recesses arranged at intervals of ninety degrees. The opening of the locking disk and the cross section of the shaft can be shaped in such a way, for example, with four chords or flattened portions, that four positions which are offset by 90 degrees are formed between the locking disk on one side and the shaft on the other side, so that 90-degree locking is possible.

BRIEF DESCRIPTION OF THE DRAWINGS

The invention will now be explained more fully with reference to embodiment examples shown in the drawings.

DESCRIPTION OF THE PREFERRED EMBODIMENTS

Figure 1A:
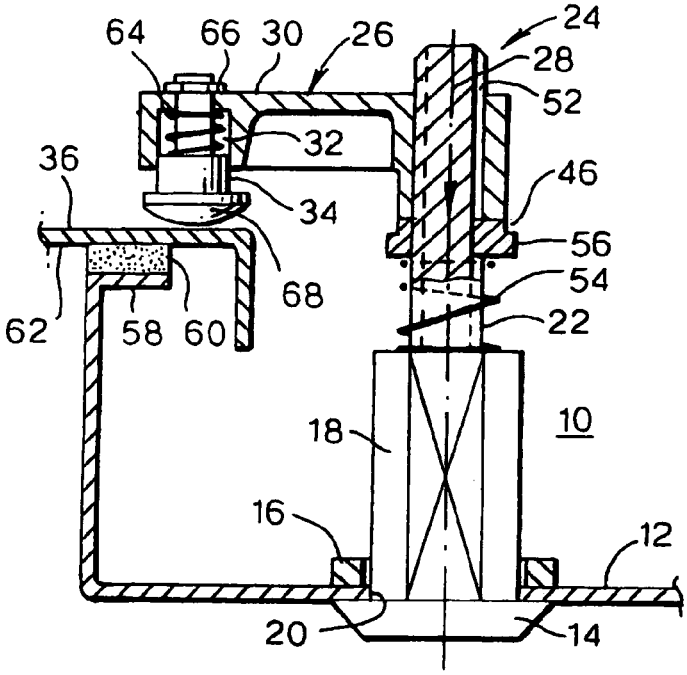
FIGS. 1A and 1B show a side view and a rear view of a pull-turn bolt with quick adjustment of the rotating bolt distance from the thin wall holding the closure.

FIG. 1A shows a pull-turn bolt closure 10 which is held in an opening 20 in a thin wall such as a door leaf 12 by its housing 18 which has a flange 14 and a coupling nut 16. The housing 18 holds a closure driveshaft 24 provided with an external thread 22 so as to be rotatable and displaceable to a limited extent. A bolt 26 is held on this closure driveshaft 24 so as to be adjustable in direction of the shaft axis 28. The bolt 26 shown here has, at its free end 30, a bore hole 32 with a back-engaging device 34 which is constructed as a pin and which is adjustable perpendicular to the back-engagement plane 36.

Figure 2A:
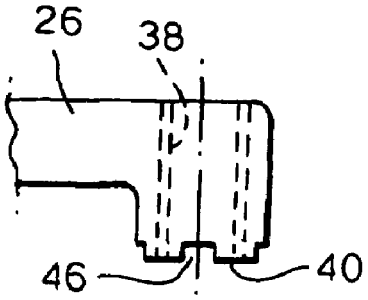
FIGS. 2A and 2B show a side view and a bottom view of the rotating bolt used in FIG. 1.
Figure 2B:
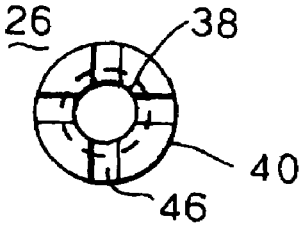
Figure 3A:
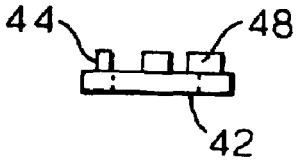
FIGS. 3A and 3B show a side view and a top view of an adjusting ring with four locking positions.
Figure 3B:
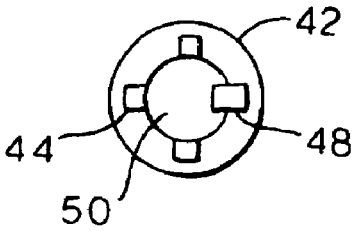

As is shown in FIG. 2A in a side view of a portion of the rotating bolt 26, this rotating bolt 26 has an internal thread 38 for screwing in the closure driveshaft 24 by its thread 22. The bottom end of the thread according to FIG. 2A passes into a coupling side 40 which acts by positive engagement, while the other side of this coupling, which presents a claw coupling, forms a coupling disk 42 which is shown from the side in FIG. 3A and from the top in FIG. 3B. The coupling disk or locking disk 42 has projections or claws 44 which are arranged at a distance of 90 degrees relative to one another and which can engage in correspondingly arranged recesses 46 at the front surface or coupling side 40 of the bolt 26. The bolt 26 can therefore be locked in with respect to the disk 42 in steps of 90 degrees. The coupling disk 42 has a bore hole 50 which allows the closure driveshaft 24, including its thread, to project through, but wherein one of the projections 44 extends into the passage of this bore hole 50 (see reference number 48) so as to cooperate with an axial slot or groove 52 which is formed on the closure driveshaft 24. In this way, the locking disk 42 is axially displaceable but not rotatable with respect to the driveshaft 24. Therefore, when the coupling disk 42 is pushed against the coupling side 40 of the bolt 26, the latter is held in the position shown here, and a spring 54 which is supported on the end of the housing 18 presses the disk 42 in this blocking function as can be seen in FIG. 1A. The coupling disk 42 forms a collar 56 so that it can be gripped by hand more easily and pushed downward against the force of the spring 54 to carry out an adjustment of the pull-turn bolt. While the disk 42 is held by the hand so as to be disengaged, the rotating bolt 26 can be turned around the driveshaft 24 and, accordingly, the distance of the back-engaging device 34 from the back-engagement surface 36 can be changed by means of the thread. When the proper adjustment is achieved, the locking disk 42 is released and engages again in the front side 40 of the rotating bolt 26, in which position the rotating bolt 26 is held so as to be rigid against rotation with respect to the shaft 24.

Figure 5:
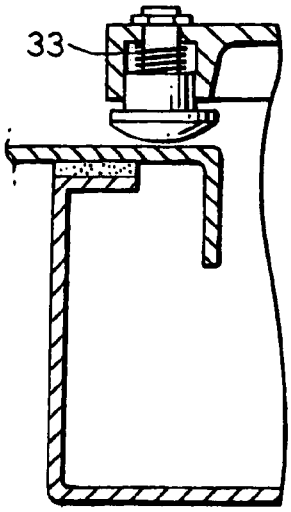
FIG. 5 shows a partial view of FIG. 1A to illustrate the pushed in state (closed position) of the closure.
Figure 1B:
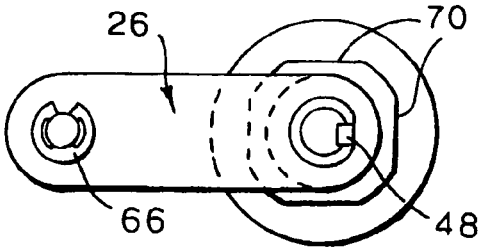

The adjustment is carried out in such a way that, with the pull-turn bolt 26 tightened, a door leaf 12 is pressed with its edge 58, possibly having a seal 60, e.g., against a frame 62 until the seal 60 closes. This state is shown in FIG. 5. The spring-loaded pin 34 enables the desired compensation of tolerances and a self-adjusting compression of the seal 60. The spring 32 is supported on the head shoulder area of the pin 34 on one side and on a shoulder 64 formed by the bore hole 32 on the other side. The retaining ring 66 at the end of the pin 34 prevents the pin from falling out of the rotating bolt 26. The construction shown in FIGS. 1A and 1B accordingly enables a pre-adjustment by means of the thread 38 of the bolt 26 and a fine adjustment of height compensation by the displaceable arrangement of the back-engaging device 34 formed by the pin 34. It will be noted that the head of the pin is rounded, see reference number 68, so that it can also stop on the back-engagement area 36 in the partially tightened state.

A rounded pin head is also suitable for a standard turn-pull bolt.

The housing 18 has flattened portions 70 (preferably four pieces at intervals of 90 degrees) which cooperate with corresponding narrowed portions in the opening 20 of the door leaf 12 and accordingly enable mounting at intervals of 90 degrees so as to be rigid against rotation.

Figure 4A:
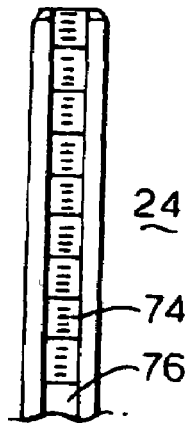
FIGS. 4A and 4B show a side view and a cross-sectional view of a driveshaft which is provided with a slot and which also carries a graduation.
Figure 4B:
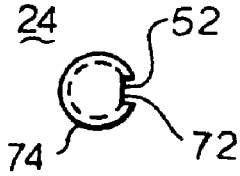

The groove 52 has a base, which base surface 72 can be used for arranging a graduation (see FIGS. 4A, 4B) which makes it possible to pre-adjust the bolt 26 on the shaft 24 prior to mounting in a cabinet.

When the driveshaft 24 is likewise provided with a flattened portion 74, it is possible to arrange another graduation 74 with better visibility than that arranged in the base 72 of the groove.

Figure 6:
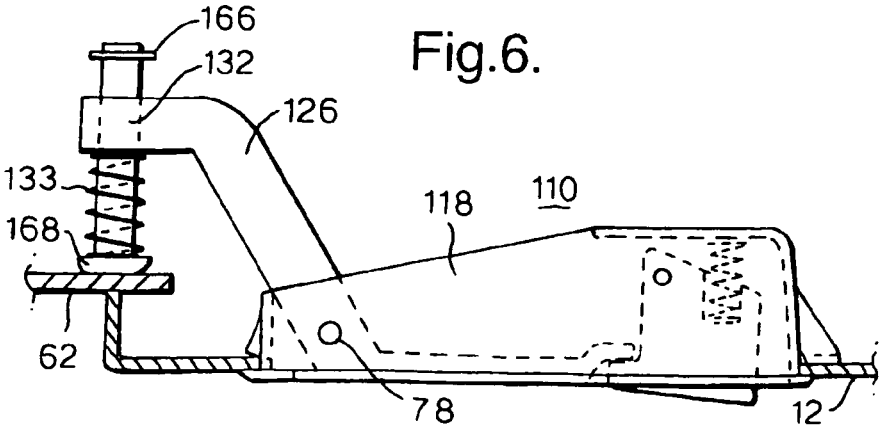
FIG. 6 shows a side view of a swivel lever with adjusting device which is designed according to the invention.

The special feature of the spring-loaded pin is also used in a swiveling bolt according to FIG. 6 which is not otherwise adjustable. The swivel bolt closure 110 shown in FIG. 6 comprises a housing 118 which can be snapped into an opening in a door leaf 12. A swivel bolt 126 which is swivelable around an axis, see 78, is arranged in the housing 118. The free end of the swivel bolt 126 also carries a bore hole 132 in which a head pin 168 is supported so as to be displaceable against the force of a pressure spring 133. A lock washer 166 limits the thrust path.

In this case also, the spring-loaded pin results in a compensation of tolerances in case of imprecise manufacture and when sealing measures are undertaken.

When the head 68 of the pin 34 is fashioned spherically, the tolerance compensating device according to the invention can also be used in standard rotating bolts.

Figure 7C:
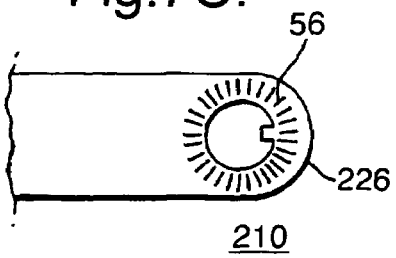
FIG. 7C shows a partial top view of the rotating bolt.
Figure 7A:
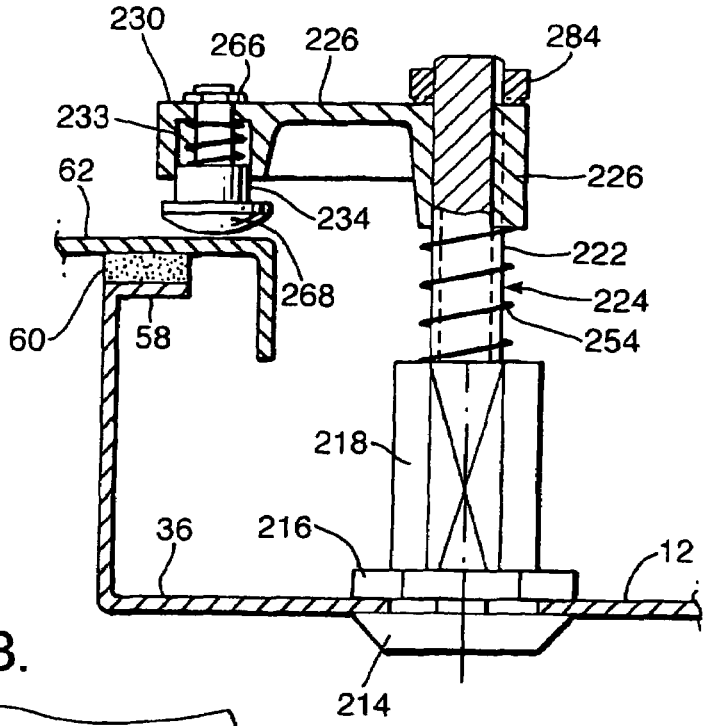
FIGS. 7A and 7B show another embodiment form of the invention in views similar to those in FIGS. 1A and 1B.
Figure 7B:
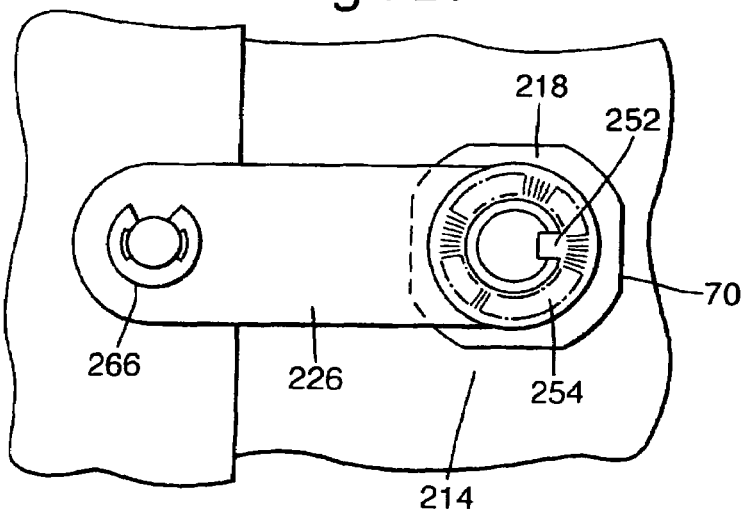

In the embodiment form shown in FIGS. 7A and 7B, a closure housing 218 is held in a door leaf 12 by means of coupling nuts 216 in a manner similar to that shown in FIG. 1A. Flattened portions 70 prevent rotation in the opening in the thin wall 12. The housing 218 supports a driveshaft 224 on which a tongue 226 without a thread can slide axially but is fixed with respect to rotation, e.g., by means of a groove 352 in which a corresponding projection of the tongue or rotating bolt 226 engages. A pressure spring 254 which is supported at the housing 218 and which encircles the shaft 224 presses the tongue 226 against a knurled nut 284 which cooperates with a thread on the shaft 224 and accordingly makes it possible to adjust the distance of the back-engagement surface 268 of the tongue from the door leaf plane 36.

Figure 7D:
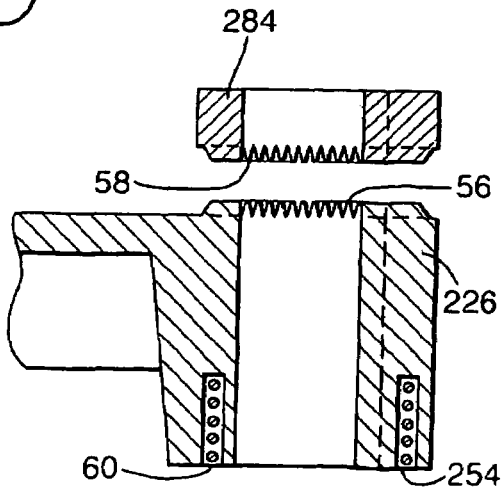
FIG. 7D shows a partial view of the rotating bolt in axial section.

The tongue 226 can have a toothed surface 56 according to FIGS. 7C and 7D which engages with a corresponding toothed surface 58 of the knurled nut 284 so as to lock the latter.

Further, according to FIG. 7D, the tongue 226 can have a cylindrical recess 60 for receiving the compressed spring 254.

The springing tolerance compensation has an ancillary effect in that it relieves pressure when arcing occurs in the switch cabinet or when an impermissible overpressure occurs in other applications such as air conditioning or exhaust systems.

COMMERCIAL APPLICABILITY

The invention is commercially applicable in switch cabinet construction.

While the foregoing description and drawings represent the present invention, it will be obvious to those skilled in the art that various changes may be made therein without departing from the true spirit and scope of the present invention.

REFERENCE NUMBERS

10, 110, 210 pull-turn bolt closure; swiveling bolt closure
12 thin wall, door leaf
14, 214 flange
16, 216 coupling nut
18, 118, 218 housing
20 opening
22, 222 external thread
24, 224 closure driveshaft
26, 126, 226 pull-turn bolt; swiveling bolt, tongue
28 shaft axis

30, 230 free end
32, 132, 232 bore hole
33, 133, 223 spring
34, 134, 234 bolt, back-engaging device
36 back-engagement plane
38 internal thread
40 coupling side
42 coupling disk, locking disk
44 projection, claw
46 recess
48 projection
50 bore hole
52, 252 groove
54, 254 spring
56 collar
58 edge
60 seal
62 frame
64 shoulder
66, 166, 266 retaining disk
68, 168, 268 rounded stop
70 flattened portions
72 base
74 graduation
76 flattened portion
78 axis

The invention claimed is:

1. A closure comprising:

a pull-turn bolt or swiveling bolt for mounting in thin walls, the bolt having a tolerance compensating device with a back-engaging device located at a free end of the bolt;

said bolt having a bore hole near its free end in which the back-engaging device is held so as to be displaceable perpendicular to a back-engagement plane of a back-engagement surface of a frame;

said back-engaging device having a spring which forces a contacting portion of the back-engaging device in a direction towards the back-engagement surface of the frame when the closure is in the closed position, so that the contacting portion of the back-engaging device contacts the back-engagement surface of the frame;

said back-engaging device adapting to varying distances between the free end of the bolt and the back-engagement surface of a frame by expansion and compression of the spring during use, so as to maintain contact with the back-engagement surface of the frame without need for manual adjustment of the back-engaging device; and said closure having a housing which holds said pull-turn bolt so as to be axially displaceable and rotatable or said closure having a housing which supports said swiveling bolt.

2. The closure according to claim 1;

wherein the back-engaging device is a head pin which is displaceable by the back-engagement surface being part of the frame in the bolt against spring force.

3. The closure according to claim 2;

wherein the base of the pin carries a retaining ring which limits the movement of the pin due to the spring force.

4. The closure according to claim 1;

wherein the head of the head pin is spherical or rounded.

5. The closure according to claim 1;

wherein the bolt is a pull-turn bolt of a closure wherein the closure comprises a closure driveshaft which is provided with an external thread and which holds the pull-turn bolt so as to be adjustable axially, wherein the pull-turn bolt carries or forms an internal thread for screwing in the closure driveshaft and one side of a coupling which acts by positive engagement, whose other side is held by the closure driveshaft so as to be rigid against rotation.

6. The closure according to claim 5;

wherein the driveshaft has a noncircular cross section that is an axially extending groove or flattened portion, and the portion of the claw coupling that is rigid against rotation with respect to the driveshaft has an opening which fits this cross section, and in that holding devices are provided which press the coupling parts or coupling sides together.

7. The closure according to claim 6;

wherein the holding devices are formed by a spiral spring which is slid onto the shaft.

8. The closure according to claim 7;

wherein the coupling part which contacts the spring has a projecting rim or grip collar.

9. The closure according to claim 7;

wherein a tongue has a cylindrical recess for receiving the compressed spring.

10. The closure according to claim 6;

wherein the actuation shaft which is noncircular in cross section has at least one axially extending flattened portion, and in that this flattened portion carries an adjusting graduation.

11. The closure according to claim 6;

wherein the coupling disk has four claws or projections/recesses arranged at intervals of ninety degrees.

12. The closure according to claim 11;

wherein the opening of the locking disk and the cross section of the shaft are shaped with four chords or flattened portions, that four positions which are offset by 90 degrees are formed between the locking disk and the shaft so that 90-degree locking is possible.

13. The closure according to claim 1;

wherein the bolt is a pull-turn bolt of a closure, wherein the closure comprises a closure driveshaft which is provided with an external thread and which holds the pull-turn bolt so as to be axially adjustable, wherein the driveshaft has a noncircular cross section that is an axially extending groove or flattened portion, and the bolt has an opening which fits this cross section, and in that holding devices are provided which force the bolt outward and stop devices which hold the bolt axially.

14. The closure according to claim 13;

wherein the holding devices are formed by a nut which is screwed onto the shaft.

15. The closure according to claim 14;

wherein a tongue has a toothed surface which engages with a toothed surface of the knurled nut so as to lock the latter.

* * * * *